United States Patent [19]

Del Signore, II et al.

[11] Patent Number: 5,074,690

[45] Date of Patent: Dec. 24, 1991

[54] PRINT HEAD CARRIAGE HOMING SYSTEM

[75] Inventors: James R. Del Signore, II, Trumansburg; Paul S. Ferrell, Ithaca; Kathleen Maginnity, Newfield; Alan H. Walker, Barton, all of N.Y.

[73] Assignee: NCR Corporation, Dayton, Ohio

[21] Appl. No.: 544,082

[22] Filed: Jun. 26, 1990

Related U.S. Application Data

[63] Continuation of Ser. No. 278,866, Dec. 2, 1988.

[51] Int. Cl.[5] ..... B41J 19/30

[52] U.S. Cl. ..... 400/322; 400/279

[58] Field of Search ..... 400/279, 320, 322, 323, 400/328, 903

[56] References Cited

U.S. PATENT DOCUMENTS

| | | | |
|---|---|---|---|
| 3,472,352 | 10/1969 | Kondur | 400/320 |
| 3,970,183 | 7/1976 | Robinson | 400/323 |
| 4,044,881 | 8/1977 | Chai et al. | 400/320 |
| 4,076,111 | 2/1978 | Robinson et al. | 400/320 |
| 4,179,223 | 12/1979 | Kwan et al. | 400/320 |
| 4,284,362 | 8/1981 | Jackson et al. | 410/323 |
| 4,305,674 | 12/1981 | Velazquez | 400/705.1 |
| 4,338,035 | 7/1982 | Kondo et al. | 400/320 |
| 4,340,848 | 7/1982 | Hanagata | 400/320 |
| 4,543,644 | 9/1985 | Kozima et al. | 400/121 |
| 4,602,882 | 7/1986 | Akazawa | 400/322 |
| 4,643,596 | 2/1987 | Shimada et al. | 400/121 |
| 4,948,279 | 8/1990 | Ikoma | 400/323 |
| 5,007,751 | 4/1991 | Yamakawa | 400/322 |

FOREIGN PATENT DOCUMENTS

| | | | |
|---|---|---|---|
| 141243 | 5/1985 | European Pat. Off. | 400/322 |
| 104088 | 8/1981 | Japan | 400/74 |
| 199678 | 12/1982 | Japan | 400/705.1 |
| 207080 | 12/1982 | Japan | 400/322 |
| 207986 | 12/1982 | Japan | 400/74 |
| 56885 | 4/1983 | Japan | 400/322 |
| 19182 | 1/1984 | Japan | 400/322 |
| 31176 | 2/1984 | Japan | 400/322 |
| 209895 | 11/1984 | Japan | 400/322 |
| 4090 | 1/1985 | Japan | 400/322 |
| 123559 | 6/1986 | Japan | 400/322 |
| 202879 | 9/1986 | Japan | 400/74 |
| 77967 | 4/1987 | Japan | 400/322 |
| 3036 | 7/1985 | World Int. Prop. O. | 400/322 |

OTHER PUBLICATIONS

IBM Technical Disclosure Bulletin, vol. 27, No. 10B, Mar. 1985, p. 6338.

*Primary Examiner*—Edgar S. Burr
*Assistant Examiner*—Steven S. Kelley
*Attorney, Agent, or Firm*—George J. Muckenthaler

[57] ABSTRACT

A printer has a bi-directional stepper motor that drives an endless toothed belt which is secured to a print head carriage for driving the carriage back and forth across the printer along a line of printing. A timing strip is molded integral with the frame of the printer and positioned under the print head carriage. An optical sensor of the light emitting diode and phototransistor type is secured to the underside of the carriage and positioned to straddle the timing strip as the carriage is driven back and forth across the printer. The printer controller uses timing strip/sensor signals to place the print head in a home position when the printer is turned on and also when the print head has been moved from an operating position, e.g. in the case of changing a ribbon. The timing strip/sensor signals are also used to detect a carriage jam condition.

14 Claims, 10 Drawing Sheets

PRINT HEAD CARRIAGE HOMING SYSTEM

This is a continuation of co-pending application Ser. No. 278,866 filed on Dec. 2, 1988.

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and for journal printing operations, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose of the print head is pointed downward for printing on the form, slip or like media while the carriage and print head are moved above and across the form or media in the horizontal direction. Another arrangement provides for the print head to be oriented in a manner wherein the nose of the print head faces rearward in a horizontal direction from the front of the printer for printing on a slip or like form.

In the dot matrix printer which includes a print head of the circular configuration and multiple element type, there is a requirement for moving the print head and the print head carriage to appropriate and precise positions along the line of printing for dot matrix printing of alpha numeric characters or of graphics type characters.

Representative documentation in the field of print head carriage drive systems includes U.S. Pat. No. 3,472,352, issued to N. Kondur on Oct. 14, 1969, which discloses an endless timing belt, a print element having a home position, and a control system that includes a switch which responds to the home position and also to a predetermined movement of print element travel.

U.S. Pat. No. 4,044,881, issued to H. D. Chai et al. on Aug. 30, 1977, discloses a stepper motor and sensor elements movable with a print head carrier that senses the presence of teeth of a toothed stator bar to generate timing signals for controlling operation of the printer and motion of the carrier.

U.S. Pat. No. 4,076,111, issued to P. I. Robinson et al. on Feb. 28, 1978, discloses an opaque flag on the print head carriage that interrupts light from a LED from reaching a phototransistor when at the left hand margin.

U.S. Pat. No. 4,179,223, issued to O. Kwan et al. on Dec. 18, 1979, discloses left, center and right sensors for detecting the margins and the center location of the print carriage and shutter means mounted on the carriage for selection of the amount of travel of the carriage.

U.S. Pat. No. 4,284,362, issued to T. Jackson et al. on Aug. 18, 1981, discloses printer control logic for providing signals indicative of print head movement and operation of the print head.

U.S. Pat. No. 4,338,035, issued to H. Kondo et al. on July 6, 1982, discloses a printer with a movable print head carriage along with a slitted plate and a carriage position detector on the carriage and astride the slitted plate.

U.S. Pat. No. 4,543,644, issued to Y. Kozima et al. on Sept. 24, 1985, discloses a control circuit having a microprocessor, a RAM, a shift register and a DMA controller.

U.S. Pat. No. 4,602,882, issued to H. Akazawa on July 29, 1986, discloses a control circuit that detects the change of level of a home position signal in synchronism with a print position signal. A detector detects slots in a disk signaling print position.

And, U.S. Pat. No. 4,643,596, issued to T. Shimada et al. on Feb. 17, 1987, discloses a printer wherein a home signal is generated each time the print head leaves its home position. The printer uses a single detector cooperating with a slotted disk.

SUMMARY OF THE INVENTION

The present invention is directed to a dot matrix printer. More particularly, the invention includes a mechanism for moving a print head carriage to precise positions along a line of printing during printing operations. The printer includes a bi-directional stepper motor supported at the right-hand side of the printer for driving an endless toothed belt that is coupled to a first or motor pulley and is coupled to a second pulley spaced across the printer from the motor pulley. The endless toothed belt is secured or connected to the carriage that supports the print head which is moved across the printer in an arrangement to provide bi-directional printing.

The second pulley is supported and is journaled at the left side of the printer and is a part of a gear pulley arrangement (or pulley gear configuration) that is provided to drive the inking ribbon for the printer.

The print head carriage is of unitary construction and includes a plurality of bearings which ride along guide rails or shafts of the printer. The guide shafts are attached to the molded frame of the printer by means of snap-in bearing mounts and the carriage is moved by means of the electric stepper motor in transverse direction.

The dot matrix print head is supported on the carriage and includes a plurality of actuating coils for driving print wires in printing operation as the print head and carriage assembly are moved back and forth across the printer.

A plastic timing strip is molded integral with the frame of the printer and is positioned under the print head carriage. An optical sensor of the light emitting diode and phototransistor type is secured to the underside of the print head carriage and is located in a position to straddle the timing strip as the carriage is driven back and forth across the printer.

A printed circuit board and a ribbon type cable are connected to carry print head and optical sensor signals to and from a printer controller.

The timing strip/optical sensor arrangement provides a carriage drive system that performs a first function of sensing carriage motion and a second function of sensing an initial home position of the carriage. As the print head carriage is moved by the stepper motor and timing belt drive arrangement, the optical sensor scans slots in the timing strip and sends motion signals in the form of square waves to the printer controller. The presence of signals indicates carriage motion and the absence of signals indicates a carriage non-motion or jam condition. The optical sensor/timing strip arrangement provides for initializing a predetermined or home position of the print head carriage. The print head carriage is moved in a leftward direction upon power-up conditions while the printer controller looks for absence of timing signals. At the instant when the timing signal is absent, the carriage is in the home position at the left side of the printer. The timing strip/optical signals are used by the printer controller to place the print head in a home position and also to sense carriage motion.

In accordance with the present invention, there is provided a print head carriage drive system for a printer having a stepper motor, a timing strip having slots therein, an optical sensor positioned to straddle the timing strip, and control means responsive to output of the optical sensor for determining home position and for detecting a jam condition of the print head carriage dependent upon a pattern of high-to-low transition periods.

In view of the above discussion, a principal object of the present invention is to provide a carriage drive system in a dot matrix printer.

Another object of the present invention is to provide a logic seeking control method for the carriage drive system in a dot matrix printer.

An additional object of the present invention is to provide a carriage drive system that provides for determining home position of the carriage and also for determining a jam condition thereof.

A further object of the present invention is to provide a timing strip/optical sensor arrangement and control circuitry that provides for both carriage home operation and carriage motion sensing as the carriage is moved across the printer.

Additional advantages and features of the present invention will become apparent and fully understood from a reading of the following description taken together with the annexed drawing.

DESCRIPTION OF THE PREFERRED EMBODIMENT

Prior to describing the structure in detail, it should be noted that the printer of the present invention is a multifunction type that can accommodate a receipt, a journal and a slip or form which form consists of one or more parts. The printer can be set in one of five different modes of operation which include printing a journal only, printing a receipt only, printing a receipt and a journal, printing a slip or form only, or printing a slip or form and a journal. The journal and the receipt can accommodate 42 columns of printing and the slip or form can accommodate 46 columns of printing.

Figure 1:
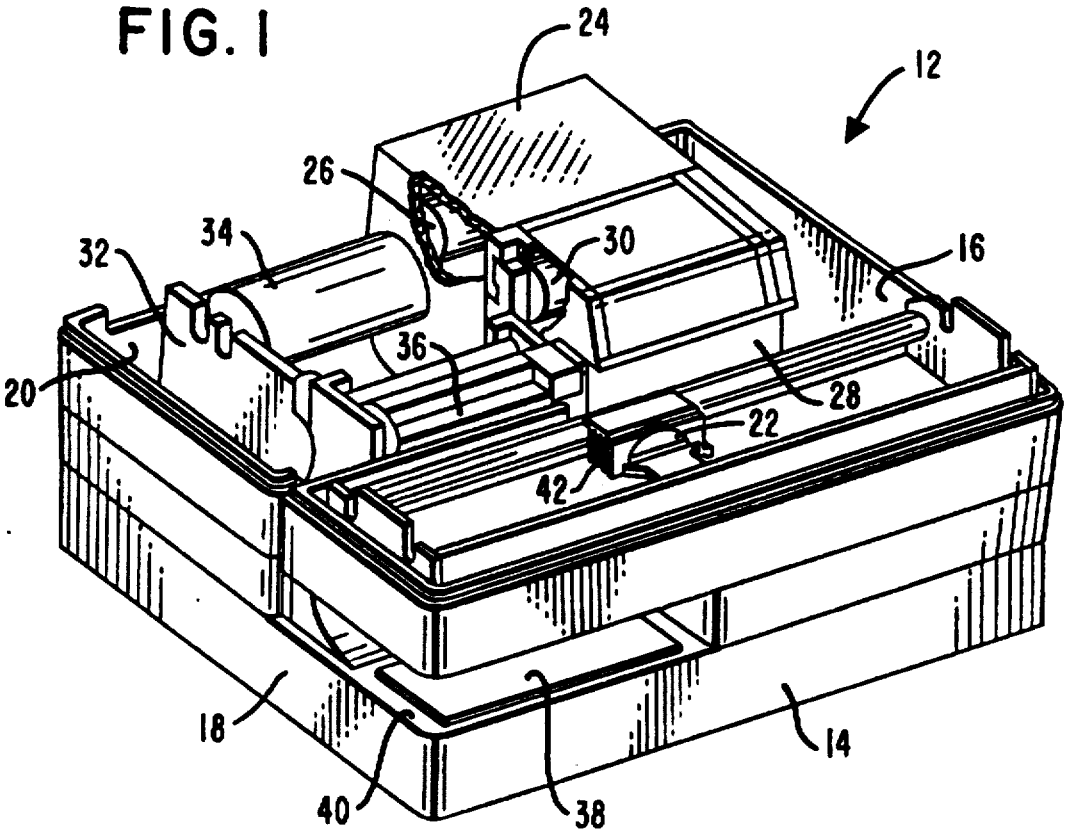
FIG. 1 is a perspective view of a printer incorporating the subject matter of the present invention.

Referring now to the drawing, FIG. 1 shows a perspective view of a printer 12 incorporating the structure of the present invention and having a front portion 14, a right side 16, a left side 18, and a rear portion 20. A wire matrix print head 22 is moved in a side-to-side manner by suitable motor drive means (FIG. 3) located at the right front corner of the printer 12. A journal station or module 24 is provided at the right side of the printer and includes a supply roll 26 of journal paper that is guided past the journal print station platen 28 and is rewound on a take-up roller 30 by a step-type drive motor (not shown).

A receipt station or module 32 is provided at the left side of the printer 12 and includes a supply roll 34 of receipt paper that is guided past the receipt print station platen 36 and is driven by a step-type drive motor (not shown). The journal station 24 and the receipt station 32 are separated by a preferred number (19) of character spaces. A ribbon cassette (not shown) of the operator-changeable type is positioned to the rear of the print head 22 (toward the viewer of the illustration in FIG. 1)

and the ribbon is driven in one direction from right to left in a path between the front portion of the print head 22 and the record media (journal, receipt or slip). A slot 40 is provided at the left front side of the printer 12 for insertion of a slip 38 which can be inserted from the front of the printer 12 or from the side thereof in a path in front of the receipt paper at the receipt station 32. A heat sink 42 is provided for the print head 22 to dissipate heat therefrom. A more detailed description of the receipt/slip station is found in U.S. Pat. No. 4,780,007, issued Oct. 25, 1988 and assigned to the assignee of the present invention.

Figure 2:
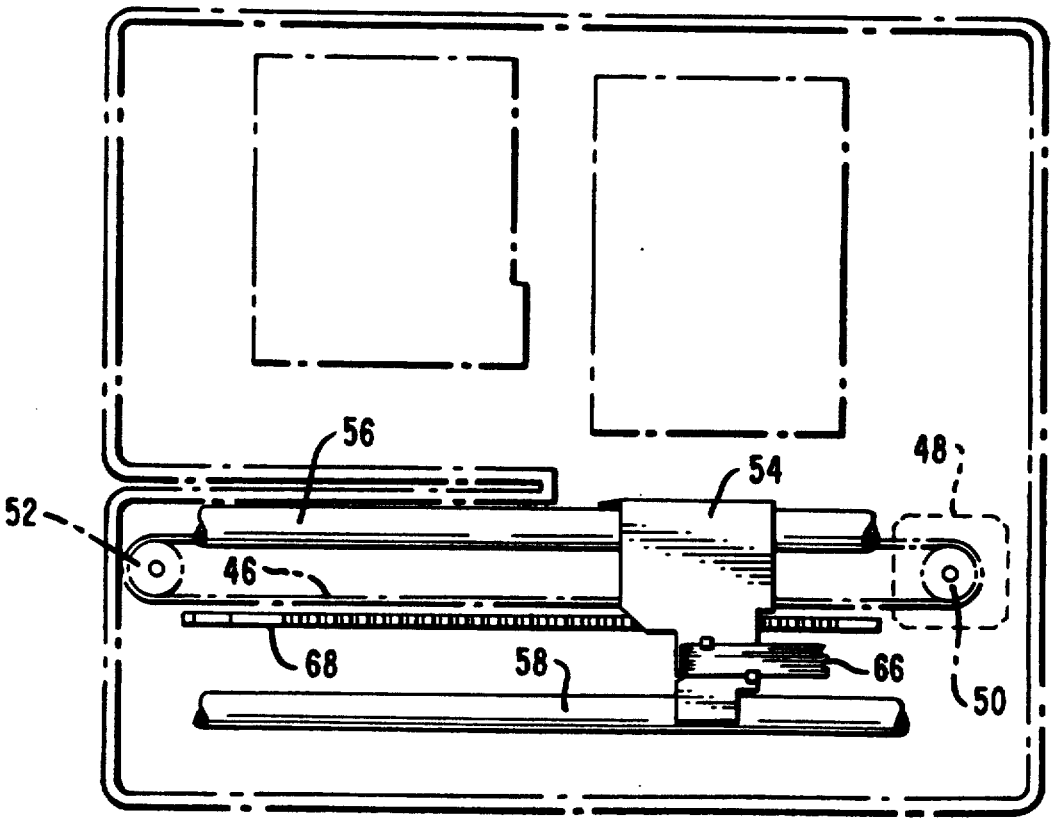
FIG. 2 is a plan view of the printer showing the relative positions of the pertinent parts.
Figure 3:
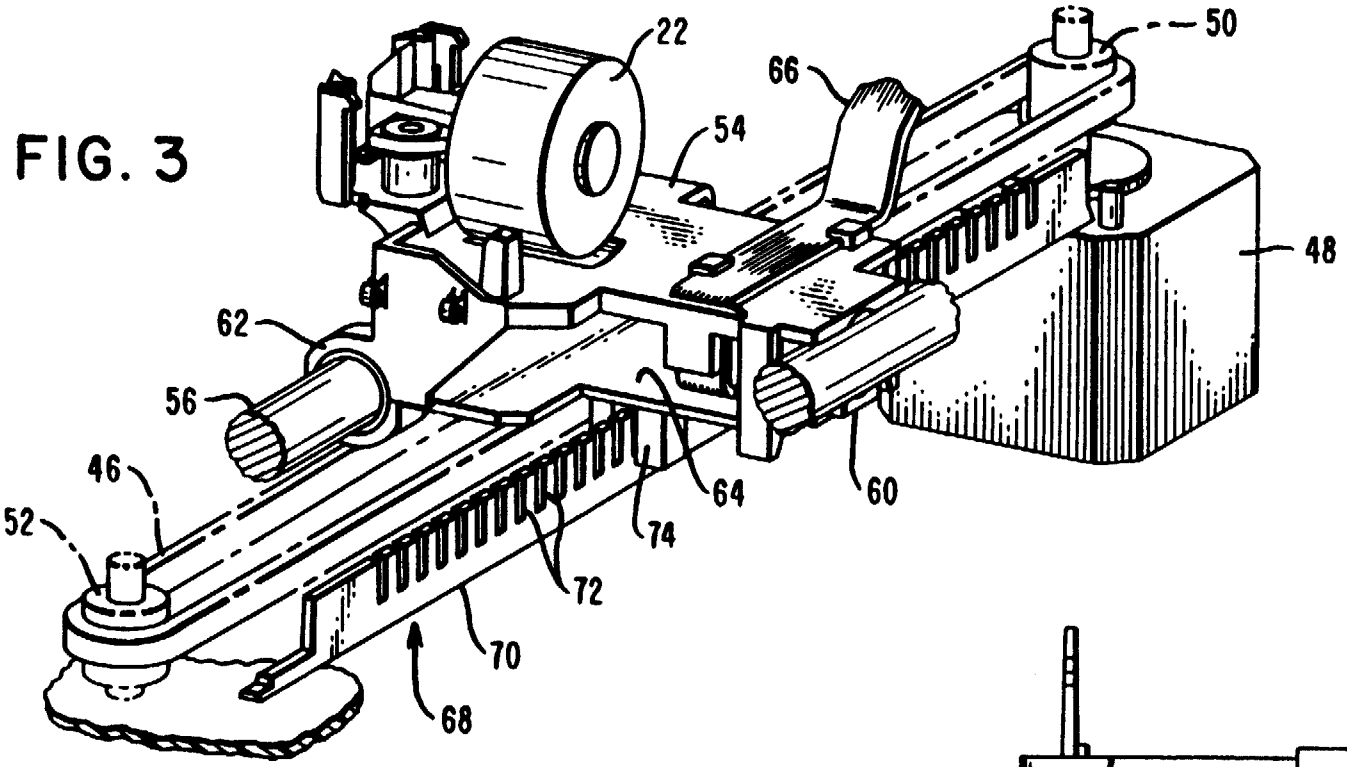
FIG. 3 is an enlarged perspective view of pertinent parts of the printer.

FIGS. 2 and 3 illustrate the drive mechanism of the present invention wherein an endless toothed belt 46, driven by the print head carriage motor drive means in the form of a stepper motor 48, is trained around a first or motor pulley 50. The motor pulley 50 is secured to and extends upwardly from the stepper motor 48. The endless toothed belt 46 is trained around a second pulley 52 at the left side of the printer 12. A print head carriage 54 is secured by means of a curved or arcuate connector to the timing belt 46 to move the carriage 54 back and forth across the printer in bi-directional printing operations. The carriage 54 supports the print head 22 in precise position for printing on the journal, the receipt, or the slip, as the case may be. The carriage 54 is supported by and rides on rails 56 and 58 (FIG. 2) by means of bearings 60 and 62 (FIG. 3). The carriage 54 is molded from conductive plastic for satisfactory ESD (electrostatic discharge) performance and for static charge control.

The carriage 54 includes a printed circuit board 64 as a part thereof which is connected to a ribbon-style cable 66. The cable 66 is connected to power and control devices in the form of circuit boards (not shown) coupled to printer control means or a printer controller providing a specific control program for operating the printer 12. The solenoids (not shown) for operating the wires of the print head 22 are connected to the printed circuit board 64 and to the cable 66.

Figure 4:
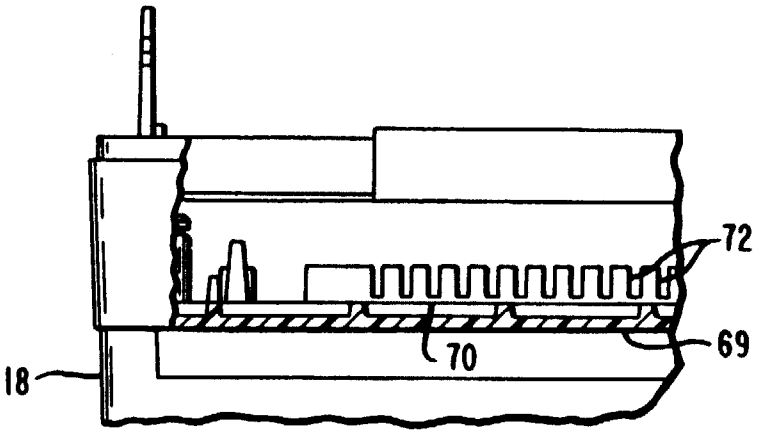
FIG. 4 is a front elevational view of a portion of the printer and showing the timing strip as an integral part thereof.

A timing strip 68 of elongated structure and made of plastic material is molded as an integral part of the frame portion 69 of the printer 12. This construction, as shown in FIG. 4, provides that the timing strip 68 is secured and fixed in one position on the printer 12 and is not subject to movement or to adjustment. The timing strip 68 includes a lower solid portion 70 and a plurality of slots 72 facing upwardly and extending substantially along the length of the timing strip 68.

An optical sensor 74 of the light emitting diode and phototransistor type is secured to the underside of the carriage 54 and straddles the timing strip 68. Output signals from the optical sensor 74 are transmitted therefrom to the ribbon cable 66 and to the printer controller.

The timing strip 68/optical sensor 74 arrangement and the program associated therewith are effective to place the print head 22 and carriage 54 at the home position and also to detect a jam condition of the print head drive motor 48 or the carriage 54.

Figure 5:
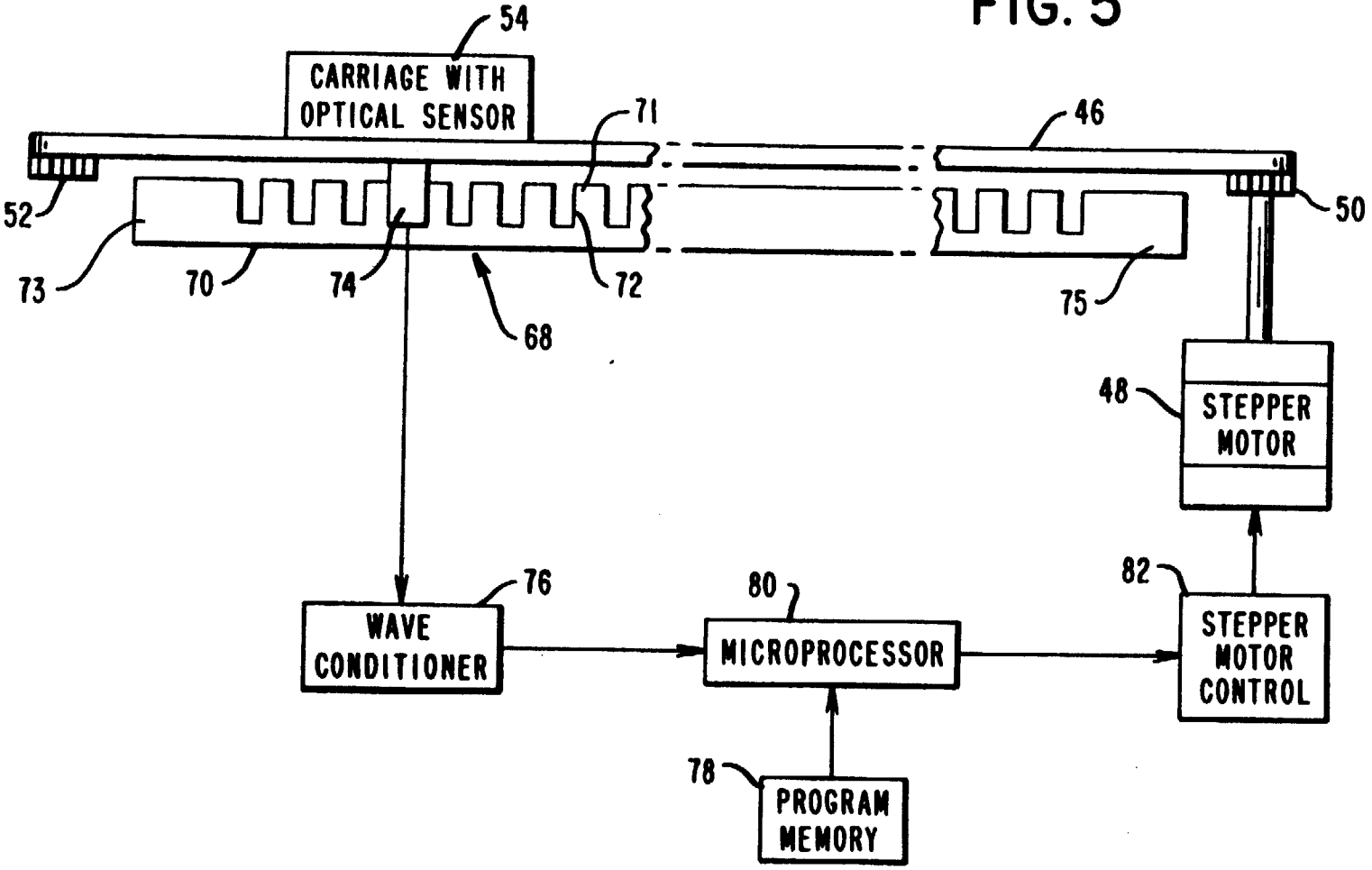
FIG. 5 is a block diagram of the pertinent parts of the printer.

FIG. 5 is a block diagram of the pertinent parts of the printer which are utilized in carrying out the objects of the invention. The stepper motor 48 is shown as being coupled to the pulley 50, which drives the endless belt 46, which belt is trained around the pulley 52. The timing strip 68 includes the lower portion 70 that is formed integral with the frame portion 69 of the printer 12 (FIG. 4) and also includes the plurality of slots 72 therein. The carriage 54 has the optical sensor 74 secured thereto with the sensor 74 being coupled to block 76 which represents an arrangement in structure that includes a wave conditioner. The wave conditioner 76 receives an input analog signal, sinusoidal in form, from the optical sensor 74 and converts the input analog signal into a digital square wave output signal. The output signal of the wave conditioner 76 is input to a microprocessor 80. A program memory 78 is coupled to the microprocessor 80 and the program memory in conjunction with the output signal of the wave conditioner 76 instructs the microprocessor 80 to produce sequential control signals to a stepper motor control 82 for operation of the stepper motor 48. The stepper motor control 82 contains the necessary power and control circuitry to maintain desired phase ampacity levels during sequential stepping operation of the stepper motor 48. The stepper motor control 82 provides the desired and necessary control for both speed and direction of rotation of the stepper motor 48 for driving the carriage 54 and the print head 22 in transverse manner on the printer 12 in bi-directional printing operations. Portions of the program memory 78 pertaining to the carriage drive system are illustrated in the flow charts of FIGS. 6–12, inclusive, and described herein.

The printer controller is a stored program in the program memory 78, executed by the microprocessor 80, to provide specific control signals for operating the printer 12, in response to commands received through the communications interface.

The printer controller uses the square wave output of the timing strip 68 and optical sensor 74 arrangement to perform two functions:

The first function is to place the printhead 22 in a known location called the home position, or home, for the purpose of correctly positioning subsequent print lines on the paper. The printer controller orients the printhead 22 to home when the printer 12 is turned on, and reorients it at certain other times during printer operation, such as when an operator has manually moved the printhead 22 in order to change the ribbon.

In the current design, either the left side of the printer 12 or the right side of the printer could be the home position, however, it is preferred to call the left side of the printer the home position.

The second function is to detect a jam condition while the carriage is moving to print or to cut paper. A jam condition can be caused by failure of, or external interference with, the carriage stepper motor 48, either of the pulleys 50 or 52, the endless toothed belt 46, the printhead 22, and other matters or conditions.

The square wave output of the timing strip/optical sensor arrangement is such that the printer controller senses a low level of the square wave while the optical sensor 74 is passing over the slots 72 in the timing strip 68. In complement, the printer controller senses a high level of the square wave while the optical sensor 74 is passing over the portions 71 of the timing strip 68 between the slots 72 and at both ends 73, 75 of the timing strip.

When the square wave output changes from a low level to a high level, a low-to-high transition has occurred, and the printer controller senses a low-to-high transition. When the square wave output changes from a high level to a low level, a high-to-low transition has occurred, and the printer controller senses a high-to-low transition.

In the current design the width of each slot 72 in the timing strip 68, as viewed in FIG. 5, is equal to the distance the carriage 54 moves in ten steps of the carriage stepper motor 48. The width of each portion 71 of the timing strip between two slots is equal to twice that of each slot 72, or the distance the carriage moves in 20 steps of the carriage stepper motor 48. The width of those portions of the timing strip 68 at each end, the portion 73 to the left of the first slot, and the portion 75 to the right of the last slot, is greater than the distance the carriage moves in 30 steps of the carriage stepper motor 48.

It is to be noted that after the printer controller accelerates the carriage drive motor 48 to printing speed, the printer controller moves the carriage drive motor 48 one step every 500 microseconds to achieve the desired print speed. It should be noted that steps less often than 500 microseconds would result in a slower print speed while steps more often than 500 microseconds would result in a faster print speed.

The printer controller uses the information provided by the square wave output of the timing strip/optical sensor arrangement to place the printhead 22 in a known location, called home in the following manner.

When the carriage 54 is moving without interference, and to orient the printhead 22 to home, the printer controller senses a low level of the square wave for ten carriage motor steps, followed by a high level of the square wave for 20 carriage motor steps, followed by a low level of the square wave for ten carriage motor steps, etc., followed finally by a high level of the square wave for more than 30 steps of the carriage stepper motor 48. At this point, the printhead is at the tentative home position.

To distinguish between home and a jam condition while establishing home, the printer controller next verifies the home position by first moving the carriage 54 to the right a certain distance out of home, and then moving the carriage 54 to the left, back into home. If the printer controller senses the correct pattern of transitions of the square wave output of the timing strip 68 at the correct time intervals, then home is established. If the printer controller senses an incorrect pattern of transitions of the timing strip 68, or an incorrect time interval between transitions, the printer controller recognizes that the printer is in a jam condition. The printer controller then stops trying to move the carriage 54 and asserts a fault condition to the communications interface.

The printer controller uses the information provided by the square wave output of the timing strip/optical sensor arrangement to detect a jam condition in the following manner.

When the carriage 54 is moving without interference, and to print or to cut paper, the printer controller senses high-to-low transitions repeatedly, at a time interval equal to 30 carriage motor steps. In the current design, if the carriage 54 is moving to print or to cut paper, and a time interval equal to 50 carriage motor steps goes by without the printer controller sensing at least one high-to-low transition, the printer controller recognizes that the carriage 54 is no longer moving and that the printer 12 is in a jam condition. The printer controller then stops trying to move the carriage 54 and asserts a fault condition to the communications interface.

The time interval equal to 50 carriage motor steps used in this design to detect a jam condition could be shorter for greater sensitivity to a jam condition or longer for less sensitivity to a jam condition.

This ability to detect a jam condition without moving the carriage 54 all the way to home improves printer throughput since not all lines require printing characters the full width of the paper all the way to home.

FIGS. 6–12, inclusive, constitute a set of flow charts describing the printer controller home algorithms in more detail.

Figure 6:
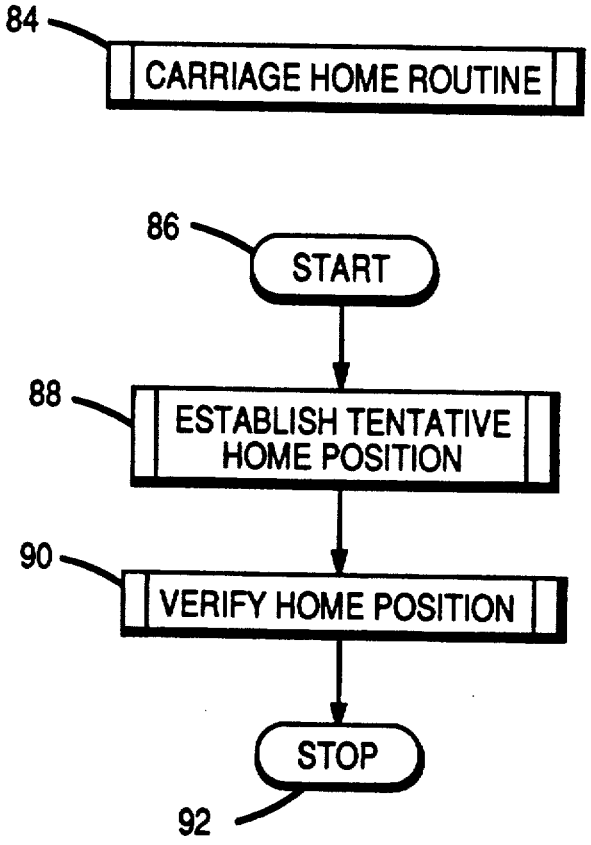
FIG. 6 is a flow chart illustrating the carriage home routine in the operation of the printer.

FIG. 6 is a flow chart of the printer controller carriage home routine, as indicated by the title block 84. The printer controller carriage home routine consists of four segments or steps carried out in sequence.

The first segment is initialization, as indicated by step 86. The second segment is a routine to establish the tentative home position, as indicated by step 88. Step 88 is described in more detail in FIG. 7. The third segment is a routine to verify the home position, as indicated by step 90. Step 90 is described in more detail in FIGS. 8 and 9. The fourth segment is finalization of the printhead in the home position, as indicated by step 92.

Figure 7:
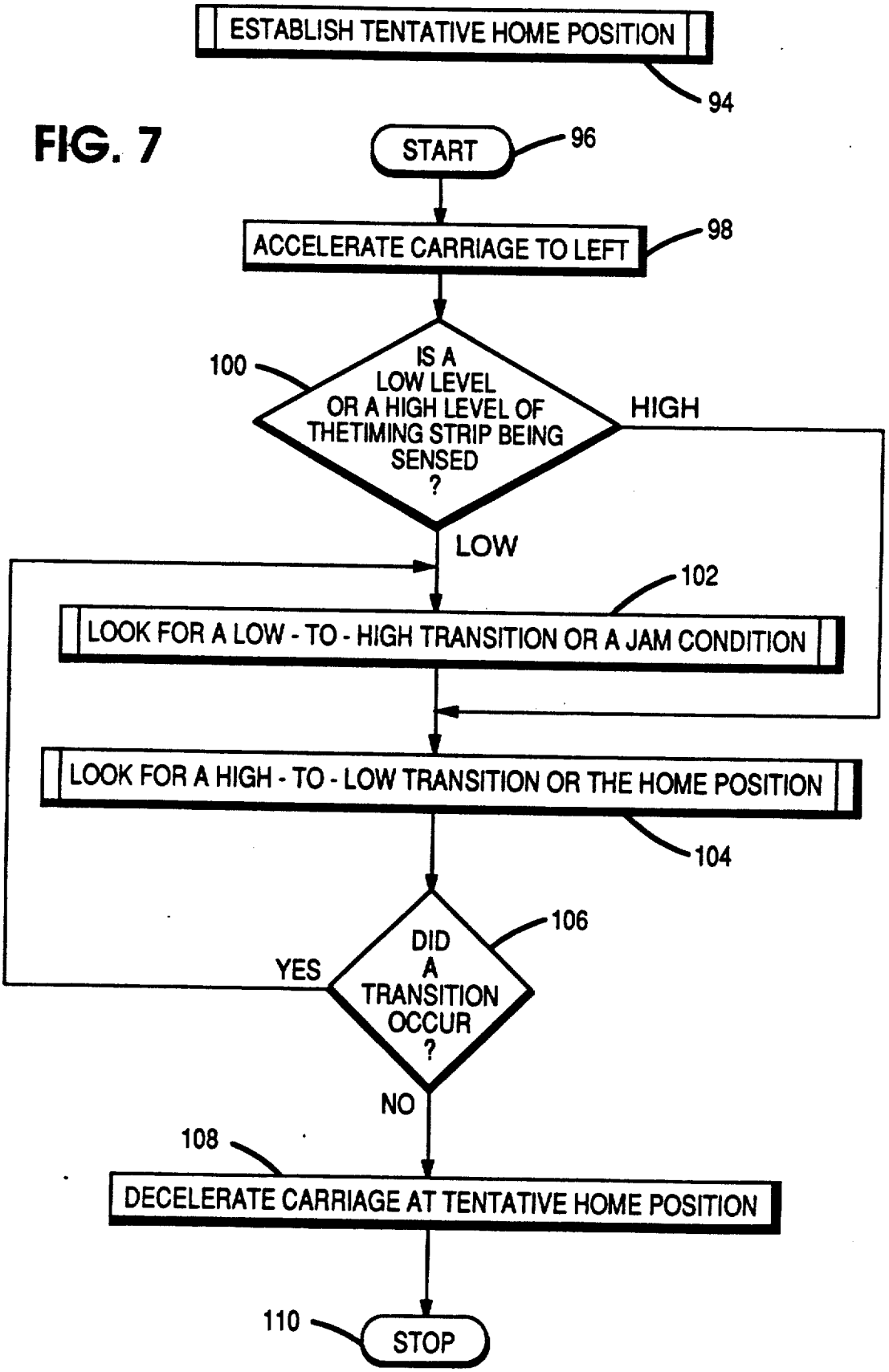
FIG. 7 is a flow chart of the printer controller routine to establish the tentative home position.

FIG. 7 is a flow chart of the printer controller routine to establish the tentative home position, as indicated by the title block 94. The printer controller routine to establish the tentative home position consists of eight segments or steps carried out in sequence.

The first segment is initialization, as indicated by step 96. The second segment is a routine to begin moving the carriage 54 to the left and accelerating it to print speed, as indicated by step 98. The third segment is a routine which examines the square wave output of the timing strip 68 at the moment in time at which the carriage 54 reaches full acceleration to print speed, as indicated by step 100. If the printer controller is sensing a low level of the square wave, program control passes to step 102. If the printer controller is sensing a high level of the square wave, program control skips step 102 and passes to step 104.

The fourth segment is a routine to look for a low-to-high transition of the square wave, or a jam condition, as indicated by step 102. If a transition occurs in step 102, then program control returns to step 104. If a jam condition is detected in step 102, then program control does not return to this routine. Step 102 is described in more detail in FIG. 10.

The fifth segment is a routine to look for a high-to-low transition of the square wave, or the home position, as indicated by step 104. Step 104 is described in more detail in FIG. 11. The sixth segment, as indicated in step 106, makes a decision based on the outcome of step 104. If a transition occurred in step 104, then program control passes from step 106 back to step 102. If a transition did not occur in step 104, then program control passes to step 108.

Program control continues to loop through steps 102, 104 and 106 until no high-to-low transition occurs in step 104.

The seventh segment is a routine to decelerate the carriage 54 at the tentative home position, as indicated in step 108. The eighth segment, as indicated by step 110, returns program control to the caller of this routine, step 88.

Figure 8:
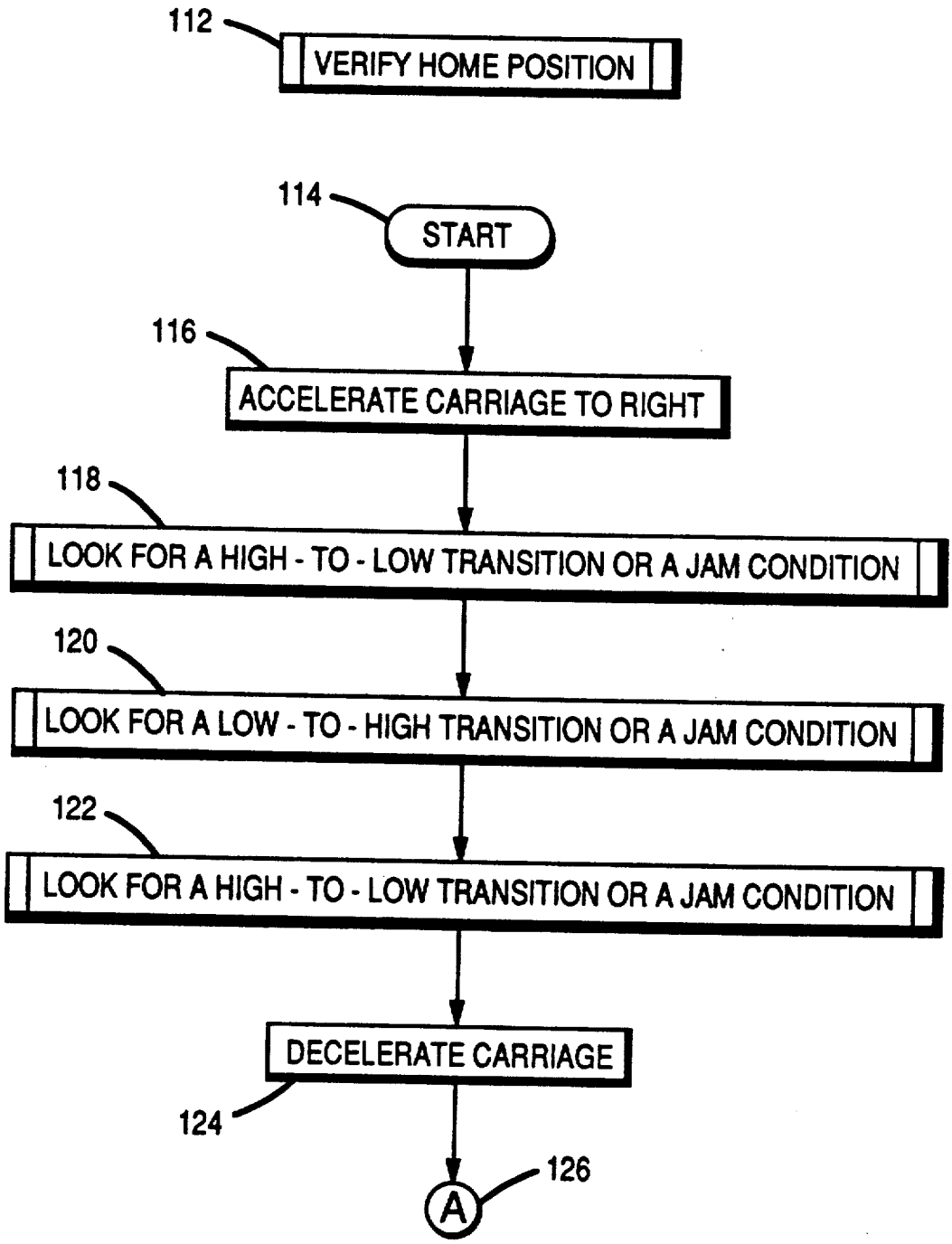
FIGS. 8 and 9, taken together, constitute a flow chart of the printer controller routine to verify the home position.
Figure 9:
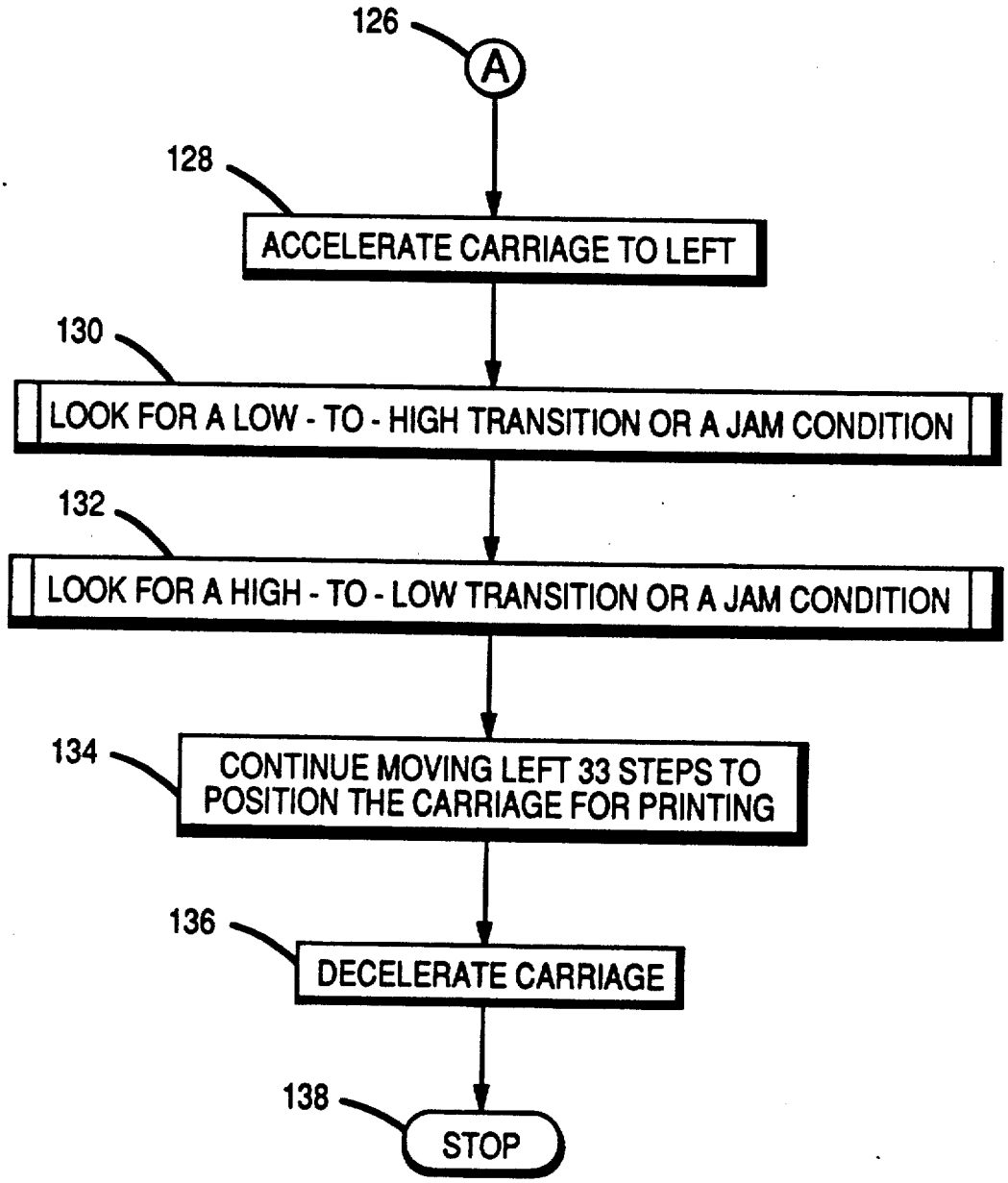

FIGS. 8 and 9 constitute a flow chart of the printer controller routine to verify the home position, as indicated by the title block 112. The printer controller routine to verify the home position consists of twelve segments carried out in sequence.

The first segment is initialization, as indicated by step 114. The second segment is a routine to begin moving the carriage to the right and accelerating it to print speed, as indicated by step 116.

The third segment is a routine to look for a high-to-low transition of the square wave, or a jam condition, as indicated by step 118. If a transition occurs in step 118, then program control returns to step 120. If a jam condition is detected in step 118, then program control does not return to this routine. Step 118 is described in more detail in FIG. 12.

The fourth segment is a routine to look for a low-to-high transition of the square wave, or a jam condition, as indicated by step 120. If a transition occurs in step 120, then program control returns to step 122. If a jam condition is detected in step 120, then program control does not return to this routine. Step 120 is described in more detail in FIG. 10.

The fifth segment is a routine to look for a high-to-low transition of the square wave, or a jam condition, as indicated by step 122. If a transition occurs in step 122, then program control returns to step 124. If a jam condition is detected in step 122, then program control does not return to this routine. Step 122 is described in more detail in FIG. 12.

The sixth segment is a routine to decelerate the carriage, as indicated by step 124.

Step 126 indicates that the flow chart of the printer controller routine to verify the home position is continued in FIG. 9.

The seventh segment is a routine to begin moving the carriage to the left and accelerating it to print speed, as indicated by step 128.

The eighth segment is a routine to look for a low-to-high transition of the square wave, or a jam condition, as indicated by step 130. If a transition occurs in step 130, then program control returns to step 132. If a jam condition is detected in step 130, then program control does not return to this routine. Step 130 is described in more detail in FIG. 10.

The ninth segment is a routine to look for a high-to-low transition of the square wave, or a jam condition, as indicated by step 132. If a transition occurs in step 132, then program control returns to step 134. If a jam condition is detected in 132, then program control does not return to this routine. Step 132 is described in more detail in FIG. 12.

The tenth segment is a routine to continue moving the carriage 54 left for 33 more carriage motor steps to position the carriage 54 for printing, as indicated by step 134. In the current design it is preferred to move the carriage 54 for a time of 33 more carriage motor steps at this point for the purpose of correctly positioning subsequent print lines on the paper. However a different number of carriage motor steps could be used without changing the intent of the design.

The eleventh segment is a routine to decelerate the carriage, as indicated by step 136. The twelfth segment, as indicated by step 138, returns program control to the caller of this routine, step 90.

Figure 10:
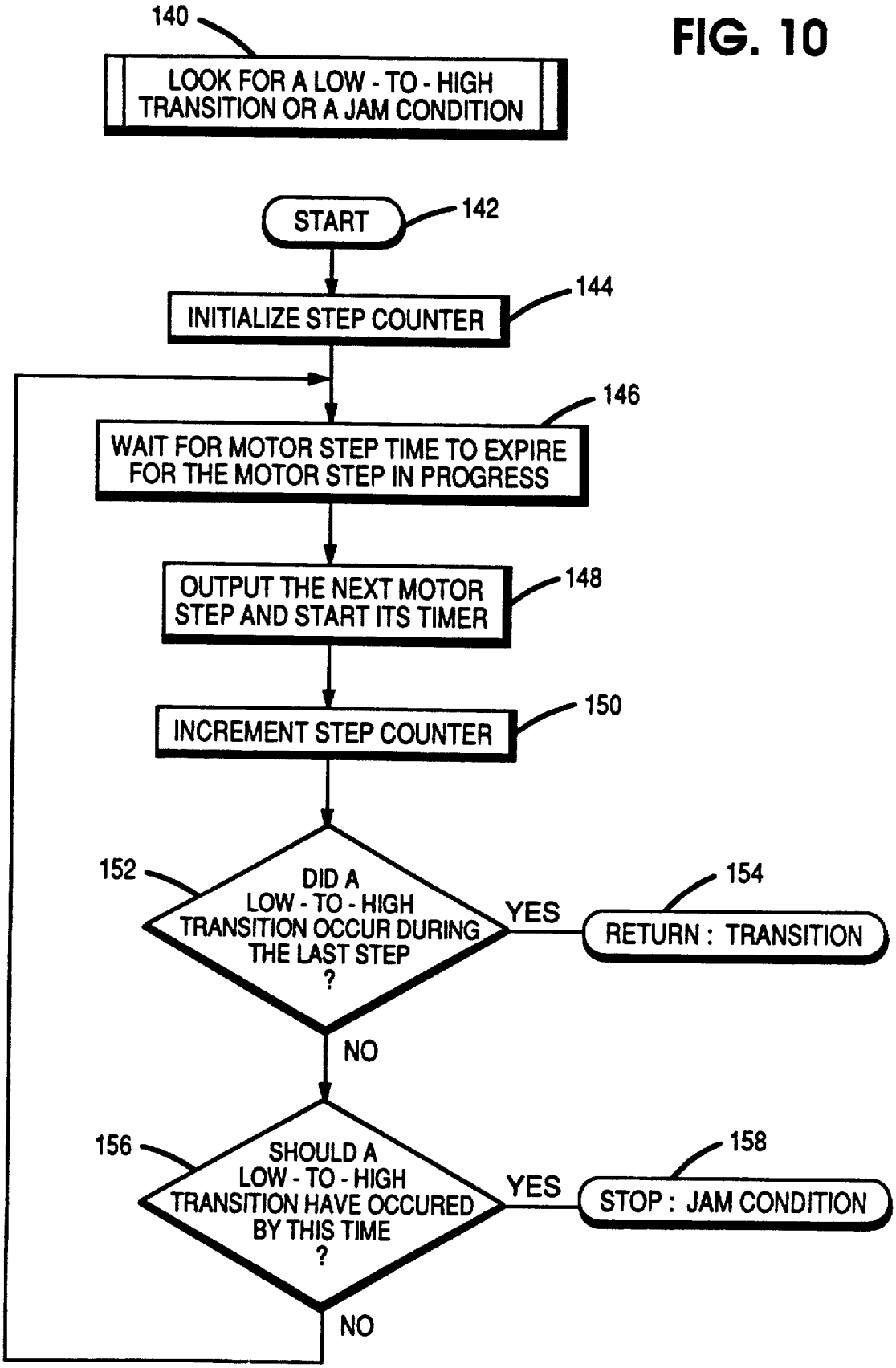
FIG. 10 is a flow chart of the printer controller routine to look for a low-to-high transition of the square wave or for a jam condition.

FIG. 10 is a flow chart of the printer controller routine to look for a low-to-high transition of the square wave, or a jam condition, as indicated by the title block 140. The printer controller routine to look for a low-to-high transition of the square wave, or a jam condition, consists of nine segments carried out in sequence.

The first segment is initialization, as indicated by step 142. The second segment is a routine to initialize a carriage motor step counter, as indicated in step 144. This carriage motor step counter is used to limit the number of times program control loops through the main part of this routine.

The third segment is a routine to wait for the motor step time to expire for the motor step in progress, as indicated in step 146. The fourth segment is a routine to output the next motor step and start its timer, as indicated in step 148. The fifth segment is a routine to increment the carriage motor step counter, as indicated in step 150.

The sixth segment, indicated by step 152, is a routine which inquires if a low-to-high transition occurred during the time of the last carriage motor step. If a low-to-high transition did occur, then program control passes to step 154, the seventh segment, which then returns to the caller of this routine, either to step 102 or to step 120 or to step 130. If a low-to-high transition did not occur, then program control passes to step 156.

The eighth segment, indicated by step 156, is a routine which inquires if a low-to-high transition should have occurred by this time, based on the current value of the carriage motor step counter. If a low-to-high transition should not have occurred yet, then program control passes back to 146. If a low-to-high transition should have occurred by this time, then program control passes to step 158, the ninth segment, which then exits to the printer controller jam condition routine.

Figure 11:
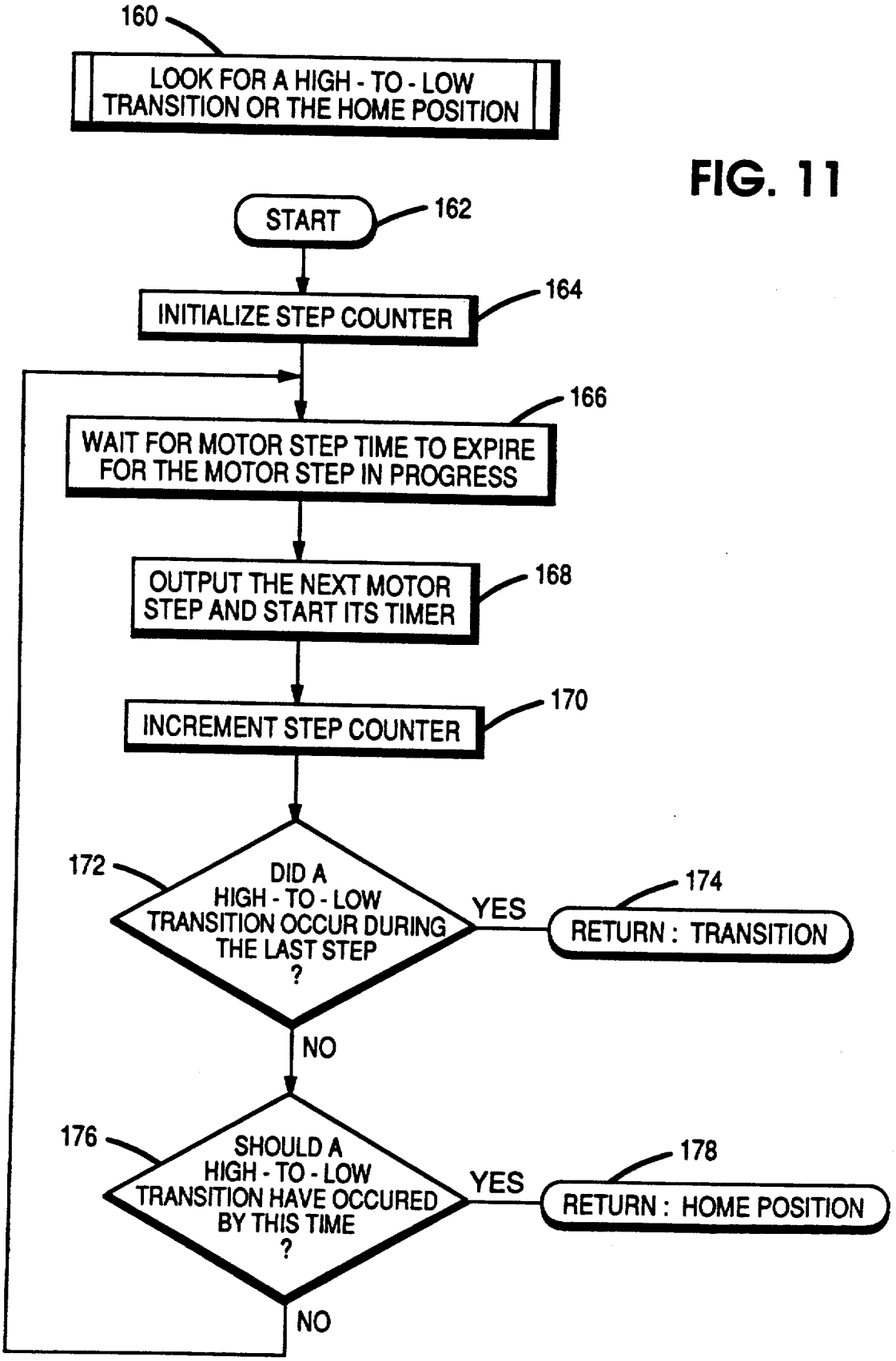
FIG. 11 is a flow chart of the printer controller routine to look for a high-to-low transition or for the home position.

FIG. 11 is a flow chart of the printer controller routine to look for a high-to-low transition of the square wave, or the home position, as indicated by the title block 160. The printer controller routine to look for a high-to-low transition of the square wave, or the home position, consists of nine segments carried out in sequence.

The first segment is initialization, as indicated by step 162. The second segment is a routine to initialize a carriage motor step counter, as indicated in step 164. This carriage motor step counter is used to limit the number of times program control loops through the main part of this routine.

The third segment is a routine to wait for the motor step time to expire for the motor step in progress, as indicated in step 166. The fourth segment is a routine to output the next motor step and start its timer, as indicated in step 168. The fifth segment is a routine to increment the carriage motor step counter, as indicated in step 170.

The sixth segment, indicated by step 172, is a routine which inquires if a high-to-low transition occurred during the time of the last carriage motor step. If a high-to-low transition did occur, then program control passes to step 174 (FIG. 11), the seventh segment, which then returns to the caller of this routine, step 104 (FIG. 7). If a high-to-low transition did not occur, then program control passes to step 176 (FIG. 11).

The eighth segment, indicated by step 176, is a routine which inquires if a high-to-low transition should have occurred by this time, based on the current value of the carriage motor step counter. If a high-to-low transition should not have occurred yet, then program control passes back to step 166. If a high-to-low transition should have occurred by this time, then the carriage may be at the home position and program control passes to step 178, the ninth segment, which then returns to the caller of this routine, step 104 (FIG. 7).

Figure 12:
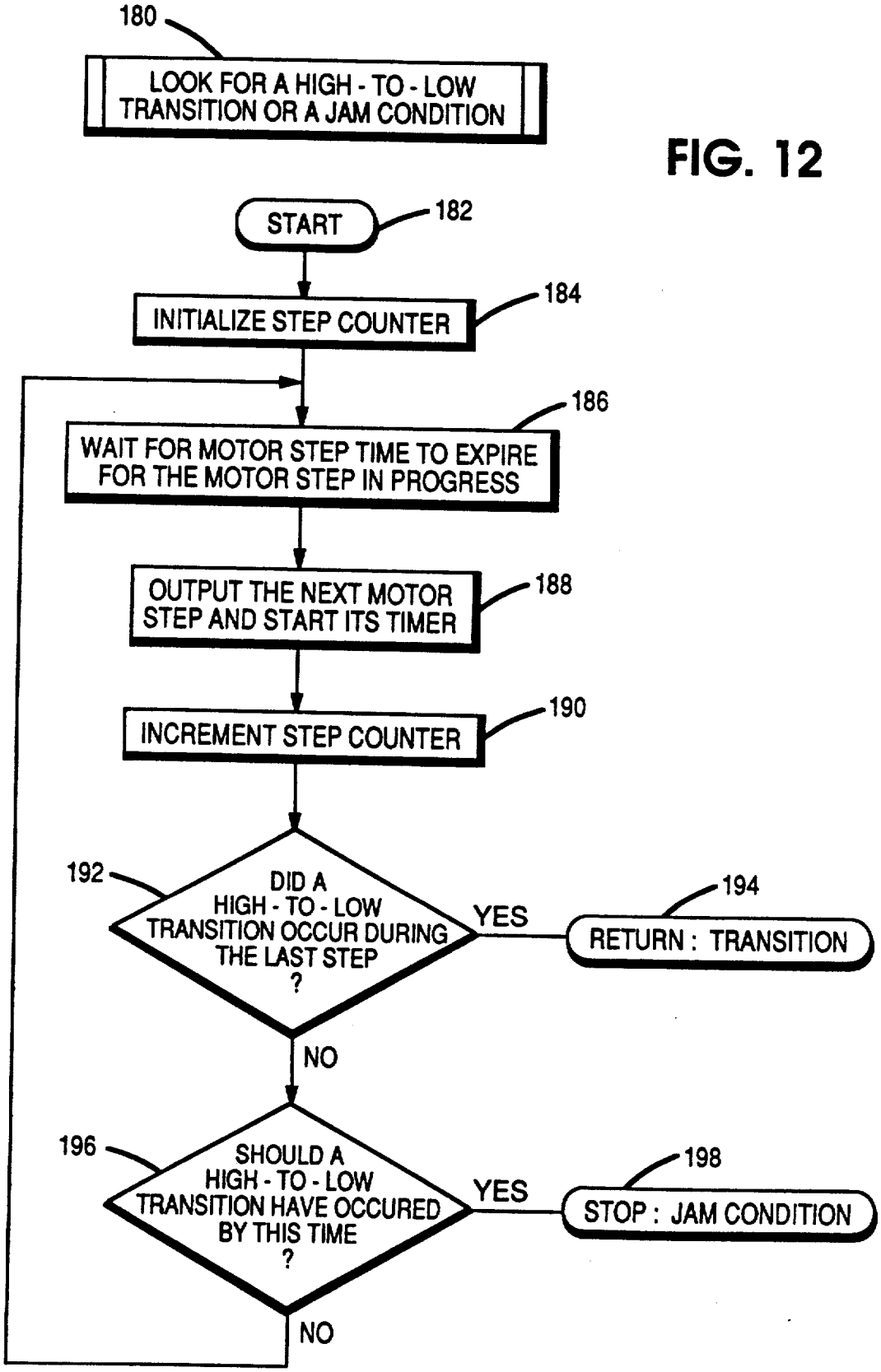
FIG. 12 is a flow chart of the printer controller routine to look for a high-to-low transition or for a jam condition.

FIG. 12 is a flow chart of the printer controller routine to look for a high-to-low transition of the square wave, or a jam condition, as indicated by the title block 180. The printer controller routine to look for a high-to-low transition of the square wave, or a jam condition, consists of nine segments carried out in sequence.

The first segment is initialization, as indicated by step 182. The second segment is a routine to initialize a carriage motor step counter, as indicated in step 184. This carriage motor step counter is used to limit the number of times program control loops through the main part of this routine.

The third segment is a routine to wait for the motor step time to expire for the motor step in progress, as indicated in step 186. The fourth segment is a routine to output the next motor step and start its timer, as indicated in step 188. The fifth segment is a routine to increment the carriage motor step counter, as indicated in step 190.

The sixth segment, indicated by step 192, is a routine which inquires if a high-to-low transition occurred during the time of the last carriage motor step. If a high-to-low transition did occur, then program control passes to step 194, the seventh segment, which then returns to the caller of this routine, either to step 118 or to step 122 (FIG. 8) or to step 132 (FIG. 9). If a high-to-low transition did not occur, then program control passes to step 196.

The eighth segment, indicated by step 196, is a routine which inquires if a high-to-low transition should have occurred by this time, based on the current value of the carriage motor step counter. If a high-to-low transition should not have occurred yet, then program control passes back to step 186. If a high-to-low transition should have occurred by this time, then program control passes to step 198, the ninth segment, which then exits to the printer controller jam condition routine.

In connection with the operations described above for carriage home routine and for carriage motion sensing, the timing strip output signals for normal carriage movement in printing operations provide repeated high-to-low or repeated low-to-high transitions. At normal printing speed, a preferred timing strip period is 15 milliseconds wherein a high level is sensed for 10 milliseconds, a low level is sensed for 5 milliseconds, a high level for 10 milliseconds, and a low level for 5 milliseconds in repeated sequence.

It is thus seen that herein shown and described is a carriage drive mechanism that is responsive to movement of travel of the print head and wherein the carriage is driven or advanced to the home position in one direction of print head travel. The mechanism and arrangement enable the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A print head carriage drive system for a printer having a frame, a print head, and an electronic printer controller, said system comprising a stepper motor, a print head carriage carrying the print head and adapted to move the print head in transverse manner for bi-directional printing operations, an endless toothed belt coupled to said stepper motor and secured to said print head carriage to move said carriage in said transverse manner, a timing strip having slots therein between portions of the strip and secured to and formed integral with the frame of the printer so as to be rigidly positioned relative to the print head carriage, and an optical sensor secured to the print head carriage and positioned to straddle the timing strip and to output signals upon sensing of the strip portions and the slots for indicating motion of the print head carriage, the sensing of a strip portion producing a high level output signal and the sensing of a slot producing a low level signal, said printer controller receiving said output signals for moving the carriage in a predetermined direction and sensing said strip portions and said slots in a pattern of high-to-low transition periods at timed intervals and sensing a high level signal for a time greater than one high-to-low transition period for establishing a tentative home position of the carriage, said printer controller moving the carriage in the opposite direction and sensing a like pattern of high-to-low transition periods at the same timed intervals for determining home position of the carriage dependent upon the times of sensing a pattern of transition periods, and then said printer controller again moving said carriage in said predetermined direction and sensing a pattern of high-to-low transition periods at the same timed intervals and sensing a high level signal for a time greater than one high-to-low transition period for verifying said home position of said carriage, and for determining a jam condition indicating non-motion of the carriage when a time greater than one high-to-low transition period expires without at least one high-to-low transition.

2. The print head carriage drive system of claim 1 including a printed circuit board and a ribbon cable coupled to said carriage for carrying signals from said print head and said optical sensor to said printer controller.

3. The print head carriage drive system of claim 1 wherein said timing strip extends substantially across said printer and is positioned under said print head carriage.

4. The print head carriage drive system of claim 1 wherein said optical sensor comprises a light emitting diode and a phototransistor for sensing said timing strip in interruptive manner and outputting signals indicating motion and non-motion conditions of the print head carriage.

5. The print head carriage drive system of claim 1 wherein the pattern of high-to-low transition periods comprises a high level for a time equal to the time of 20 carriage motor steps and a low level for a time equal to the time of 10 carriage motor steps.

6. In a printer having a print head and a print head carriage, an electronic printer controller, a stepper motor operable for moving said carriage in transverse direction for printing operations in open loop manner, the improvement comprising a timing strip having a plurality of slots therein between portions of the strip and secured so as to be rigidly positioned relative to the print head carriage, and an optical sensor secured to the print head carriage and positioned to sensed the slots and the portions in the timing strip and to output signals indicating motion of the print head carriage relative to the frame of the printer, said printer controller receiving output signals and connected with said stepper motor for moving the carriage in a predetermined direction and sensing said strip portions and said slots in a pattern of high-to-low transition periods at timed intervals and sensing a high level signal for a time greater than one high-to low transition period for establishing a tentative home position of the carriage, said printer controller moving the carriage in the opposite direction and sensing a like pattern of high-to-low transition periods at the same timed intervals for determining home position of the carriage dependent upon the time of counting a pattern of high-to-low transition periods, and then said printer controller again moving said carriage in said predetermined direction and sensing a pattern of high-to-low transition periods at the same timed intervals and sensing a high level signal for a time greater than one high-to-low transition period for verifying home position of said carriage, and said printer controller receiving output signals from said optical sensor for determining a jam condition of the print head carriage indicating non-motion of the carriage when a time greater than one high-to-low transition period expires without a high-to-low transition.

7. In the printer of claim 6 including a printed circuit board and a ribbon cable coupled to said carriage for carrying signals from said print head and said optical sensor to said printer controller.

8. In the printer of claim 6 wherein said timing strip extends substantially across said printer and is positioned under said print head carriage.

9. In the printer of claim 6 wherein said optical sensor comprises a light emitting diode and a phototransistor for sensing said timing strip in interruptive manner and outputting signals indicating both motion and non-motion conditions of the print head carriage.

10. In the printer of claim 6 wherein the pattern of high-to-low transition periods comprises a high level for a time equal to the time of 20 carriage motor steps and a low level for a time equal to the time of 10 carriage motor steps in repeated sequence.

11. In the printer of claim 6 wherein the timing strip is formed integral with the printer.

12. A method for determining home position of a stepper motor driven carriage for a print head on a printer having a printer controller, comprising the steps of:

providing a timing strip having a plurality of slots therein between portions of the strip in an arrangement wherein the timing strip is rigidly positioned relative to the carriage;

sensing the slots in the timing strip during movement of the carriage in one predetermined transverse direction and providing output signals corresponding to sensed portions and slots in a pattern of high-to-low transition periods at timed intervals and sensing a high level signal for a time greater than one high-to-low transition period for establishing a tentative home position of the carriage, sensing the portions and slots in the timing strip during movement of the carriage in the opposite transverse direction and providing output signals in a pattern of high-to-low transition periods at like timed intervals;

conditioning the output signals to timing periods of repeated patterns of high-to-low transitions; and again moving said carriage in the predetermined direction and sensing a pattern of high-to-low transition periods at the same timed intervals and verifying the home position of the carriage and then stopping movement of the carriage upon observing a final high-to-low transition period greater than one transition period at the home position of the carriage.

13. The method of claim 12 wherein the pattern of high-to-low transition periods comprises a high level signal for a time equal to the time of 20 steps of the stepper motor and a low level signal for a time equal to the time of 10 steps of the stepper motor and the final transition period is greater than the combined time of a high level signal and a low level signal for establishing the home position of the carriage.

14. The method of claim 12 including the additional step of sensing output signals and sending said output signals to said printer controller for determining a jam condition of said print head carriage and indicating non-motion of said print head carriage when a time greater than one high-to-low transition period expires without a high-to-low transition.

* * * * *